United States Patent [19]

Hull

[11] 4,278,398

[45] Jul. 14, 1981

[54] APPARATUS FOR MAINTAINING VARIABLE VANE CLEARANCE

[75] Inventor: Peter R. Hull, Ipswich, Mass.

[73] Assignee: General Electric Company, Lynn, Mass.

[21] Appl. No.: 966,304

[22] Filed: Dec. 4, 1978

[51] Int. Cl.[3] ..... F01D 17/16

[52] U.S. Cl. ..... 415/160

[58] Field of Search ..... 415/160, 161, 162

[56] References Cited

U.S. PATENT DOCUMENTS

| | | | |
|---|---|---|---|
| 2,606,713 | 8/1952 | Bauger | 415/160 |
| 3,074,689 | 1/1963 | Chapman | 415/160 |
| 3,392,958 | 7/1968 | Penny et al. | 415/160 |
| 4,046,434 | 9/1977 | Moreman | 308/195 |
| 4,046,435 | 9/1977 | Moreman | 308/195 |

FOREIGN PATENT DOCUMENTS

| | | | |
|---|---|---|---|
| 855828 | 9/1952 | Fed. Rep. of Germany | 415/161 |

*Primary Examiner*—Louis J. Casaregola

*Attorney, Agent, or Firm*—Henry J. Policinski; Derek P. Lawrence; Donald W. Walk

[57] ABSTRACT

Apparatus is provided for maintaining minimum clearance between variable position airfoils and the wall forming the gas flow path in a gas turbine engine. A constant clearance is maintained between a radially facing contoured wall surface and a radially facing contoured end face on the airfoil. The contour of the wall surface and the end face may each be spherical.

3 Claims, 3 Drawing Figures

APPARATUS FOR MAINTAINING VARIABLE VANE CLEARANCE

BACKGROUND OF THE INVENTION

This invention relates to gas turbine engines and, more particularly, to apparatus for maintaining minimum clearance between variable position airfoils and the walls forming the gas flow path associated with the engine.

It is well known in the gas turbine engine field that the performance of the engine over its cycle may be improved by utilizing variable position airfoils within various portions of the engine. By way of example, some modern day engines utilize variable stator vanes in the compressor section of the engine which typically rotate between a relatively closed position under low power conditions and a fully opened position under full power conditions. Other applications of variable position airfoils include variable position fan blades in high bypass gas turbine engines and variable inlet guide vanes and variable position turbine blades and vanes.

It is also well known that clearances between the ends of the airfoil and the walls of the flow passage have an adverse effect upon engine performance. Larger clearances cause greater losses in performance. With variable position airfoils the losses are accentuated due to the rotation of the airfoil. More specifically, the clearance between the ends of the airfoil and the adjacent aerodynamic flow path surfaces varies in accordance with the position of the vane. This result obtains from the inherent mismatch between the flow path contour which is a curved surface of revolution, and the radially facing inner and outer surfaces of the airfoil which travel in a flat plane as the airfoil is rotated. Heretofore, designers have avoided interference of the airfoil edges and the walls of the airfoil by machining away portions of the edges of the airfoil which would otherwise interfer with the flow path walls when the airfoil is disposed in the extreme closed or opened position. This technique, while assuring minimum clearances when the airfoil occupies the one position, results in large clearances when the airfoil is disposed in other rotational positions. Often large clearances occur at critical high operating time power settings and vane positions causing increased air leakage, engine performance loss and greater fuel consumption. This invention addresses the aforementioned problem relating to excessive clearances associated with variable position airfoils.

Therefore, it is an object of the present invention to provide for minimum clearances between the edges of a variable position airfoil and the walls defining the engine flow path in all rotational positions of the airfoil.

It is another object of the present invention to eliminate variations in clearance as the variable position airfoil is rotated.

SUMMARY OF THE INVENTION

Briefly stated, these and other objects, which will become apparent from the following description read in conjunction with accompanying drawings, are accomplished by the present invention which provides in one form a first axially extending wall disposed about the center line of the engine to define an annular flow path. The wall includes a circumferentially and axially extending radially facing contoured surface. A variable position airfoil resides in the flow path and includes a radially facing contoured end face disposed in spaced apart confronting relationship with the contoured surface. The airfoil is adapted to rotate about an axis of rotation inclined with respect to the engine center line and the spacing between the surface and the end face remains constant as the airfoil is rotated between first and second positions about the axis. The surface and end face may be spherical.

DESCRIPTION OF THE DRAWINGS

The present invention will be readily understood by a reading of the following description of the preferred embodiment with reference to the accompanying drawings in which.

DESCRIPTION OF THE PREFERRED EMBODIMENT

Figure 1:
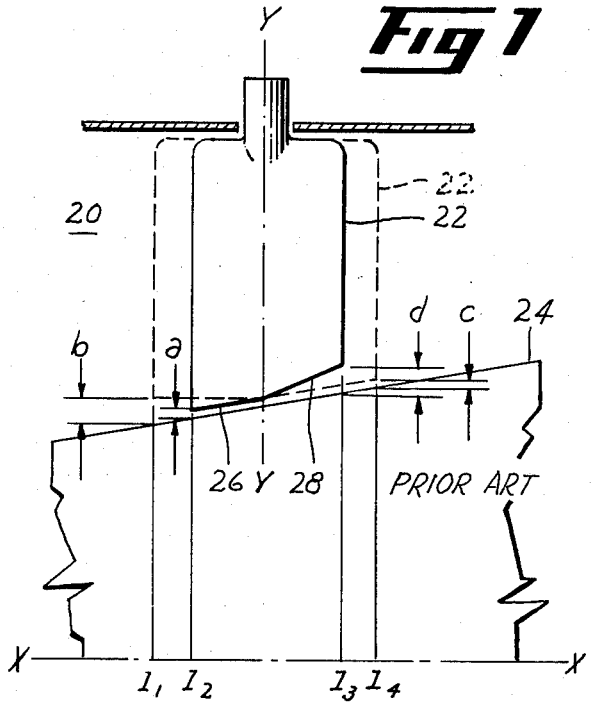
FIG. 1 is a schematic view depicting a prior art arrangement and its attendant shortcomings.

The description of the preferred embodiment of the present invention will be better understood if a brief description of prior art devices is first presented. Accordingly, attention is first directed at FIG. 1 which schematically illustrates a typical prior art arrangement and its attendant shortcomings. FIG. 1 presents a side view of a portion of an annular flow path 20 disposed about center line x—x of a gas turbine engine and partially bounded or defined by a wall 24. Disposed within annular flow path 20, variable position airfoil 22 is shown both in a relatively closed position and in a relatively open position, the latter depicted by dashed lines. Airfoil 22 is adapted to rotate between its open and closed position about radially extending vertical axis of rotation y—y. The particular configuration of wall 24 shown in FIG. 1 generally might be found in the compressor section of a gas turbine engine wherein the cross-sectional area of the annular flow channel decreases as the engine is traversed in the aft direction. Additionally, the distance of wall 24 from axis x—x typically differs at various axial locations in accordance with requirements necessary to obtain specified flow characteristics within annular flow passage 20.

As stated above, clearances between the radially facing ends of prior art airfoils and flow path walls vary as a function of position of the airfoil. Clearance variations are present since the plane of rotation of each point on the end face of airfoil 22 is not parallel to wall 24. More specifically, each point on the end face of airfoil 22 rotates in a plane which is parallel to center line x—x. However, wall 24 not only slopes in the direction of center line x—x but also in curved about center line x—x. Hence, wall 24 can be said to slope in two directions. The distance between any point on the end face of airfoil 22 and wall 24 will depend on the axial location of such a point. Since airfoil 22 is movable, the axial location of such a point will change. In this manner then, variations in clearances are caused to occur.

Figure 3:
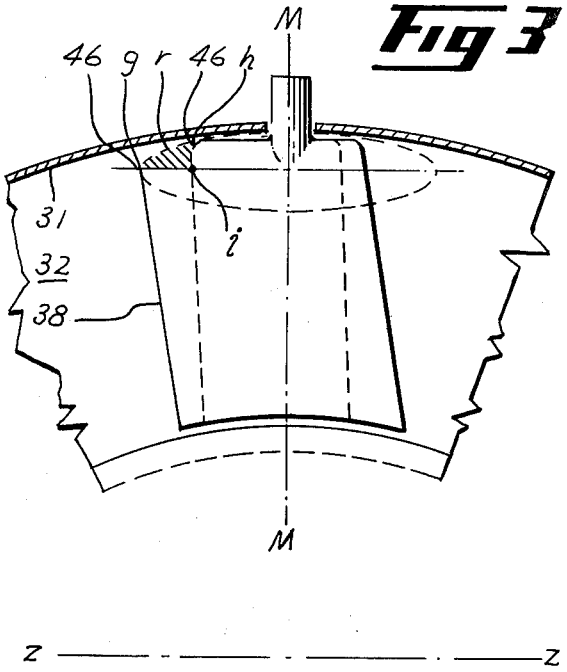
FIG. 3 is a schematic representation of an axial view of the flow passage depicted in FIG. 2 and illustrates the clearance control achieved by one aspect of the present invention.
Figure 2:
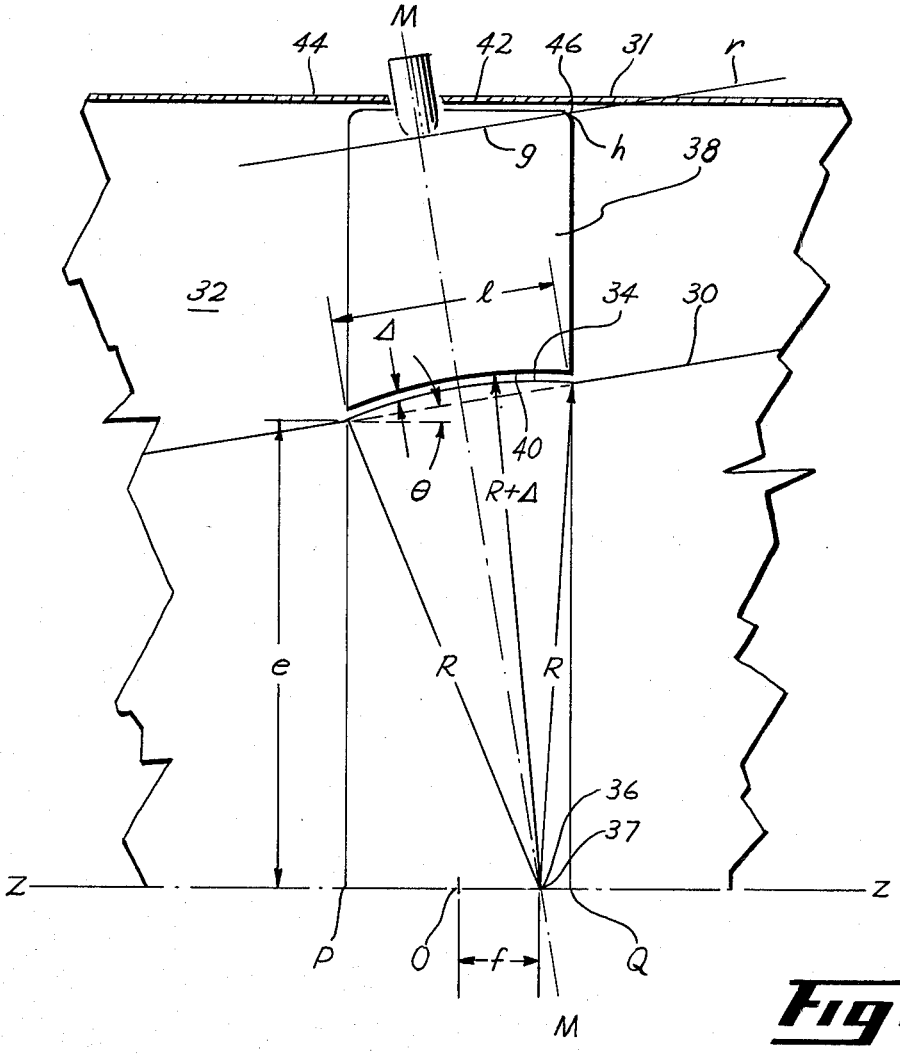
FIG. 2 is a schematic representation of the present invention as applied to a variable position airfoil disposed within a flow passage in a gas turbine engine.

For the sake of more simply illustrating the aforementioned variable clearance, assume that the radius of curvature of wall 24 is sufficiently large such that curvature into the plane of the paper in FIG. 1 is negligible. When airfoil 22 is in the closed position, the forward lower face 26 of airfoil 22 is spaced apart from wall 24 by clearance a at axial location, $1_2$. It should be stated that the magnitude of the clearances shown in FIGS. 1 and 2 and 3 are greatly exaggerated to facilitate an understanding of the prior art and this invention. With airfoil 22 disposed in the open position, the forward lower face 26 of airfoil 22 is spaced apart from wall 24 by the clearance b at the axial location $1_1$. Clearance b is greater than clearance a since the lower face 26 of airfoil 22 rotates in a horizontal plane (as viewed in FIG. 1) while the radius of wall 24 decreases from axial position $1_2$ to axial position $1_1$. Since clearance a is usually set at the minimum acceptable level for the closed position, clearance b is excessive and results in performance losses due to localized leakage and flow disturbance.

Similarly, excessive clearances are encountered at the aft lower face 28 of airfoil 22. More specifically, when airfoil 22 is in the open position the aft lower face 28 of airfoil 22 is spaced from wall 24 by clearance c at axial location $1_4$. With airfoil 22 disposed in the closed position, the aft lower face 28 of airfoil 22 is spaced apart from wall 24 by clearance d at axial location $1_3$. In this instance, minimum clearance c is established with airfoil 22 in the open position. Hence, when airfoil 22 is closed, clearance d, greater than clearance c, is excessive and causes leakage and performance loss. As airfoil 22 is rotated between the open and closed position, clearance at the forward lower face 26 varies between a and b and clearance at the aft lower face 28 varies between c and d. As stated above, it was assumed, for the purpose of more simply illustrating the prior art problems that the curvature of wall 24 into the plane of the paper was negligible. In practice, such curvature is not negligible nd will further induce larger variations in clearance.

Referring now to FIG. 2, the preferred embodiment of the present invention is depicted which provides for a constant clearance between the airfoil and the flow path boundary. Circumferentially and axially extending spaced-apart inner and outer walls 30 and 31, respectively, at least partially define the boundary of axially extending annular flow path 32. Wall 30 comprises generally a surface of revolution about axial center line z—z of a gas turbine and is disposed that as the engine is traversed from forward to aft (left to right in FIG. 2) the distance of wall 30 from the z—z axis increases. Said another way, the distance of wall 30 from the z—z axis is nonconstant. On the other hand, the distance of wall 31 from the z—z axis is substantially constant as the engine is traversed from forward to aft.

Wall 30 includes a circumferentially and axially extending generally radially facing spherically contoured surface or portion 34 which has a first center of curvature disposed at a first location 36 on the axis z—z. Since surface 34 is spherical, all points thereon are disposed at a constant distance or radius R from center 36. Center 36 lies on center line z—z at a distance f from midpoint O which is a point midway between the points P and Q that define the axial extent of the radial projection of spherical surface 34 on center line z—z. By separating center 36 from midpoint O by the distance f the spherical contour 34 will more accurately approximate the normal contour of wall 30. The magnitude of the distance f for any given application of the present invention will depend upon, among other parameters, the degree of slope of wall 30. The distance f generally is defined by the equation:

$$f = \tan\theta x(e + (l/2)\sin\theta)$$

Where $\theta$ = the axial slope of a line connecting two axially aligned points of intersection of surface 34 and wall 30 e = the radial distance from point P to the wall 30 l = the axial length of surface 34 along wall 30.

Variable position airfoil 38 resides within, and extends radially across, flow path 32 and is disposed radially adjacent to spherically contoured portion 34. Airfoil 38 includes radially facing spherically contoured end face 40 disposed in spaced apart confronting facing relationship with surface or portion 34. End face 40 has a second center of curvature disposed at a second location 37. In the embodiment of FIG. 2, the aforementioned first location 36 is coincident with the second location 37. Since end face 49 is spherical all points thereon are disposed at a constant distance or radius $R+\Delta$ from center 36 so as to provide a constant clearance $\Delta$ between portion 34 and end face 40. $\Delta$ is equal to the difference in magnitude between the radii of curvature of surface 34 and end face 40.

Variable position airfoil 30 is adapted to rotate about axis M—M which intersects axial center line z—z. Furthermore, in the preferred embodiment shown in FIG. 2 axis M—M intersects coincident centers of curvature 36 and 37.

As variable position airfoil 30 rotates between its first or opened position and its second or closed position, the radial distance between any point on surface 34 and end face 40 remains constant at $\Delta$. Additionally, the radial clearance $\Delta$ is constant between all points on surface 34 and end face 40. This constant clearance obtains since the radius of surface 34, the radius of end face 40 and the axis of rotation M—M of airfoil 30 all intersect at the same point on center 36. Additionally, since center 36 lies on the z—z axis, surface 34 may be conveniently machined as a spherically contoured surface of revolution about axis z—z on wall 30.

Axis of rotation M—M intersects center line z—z at an angle less than 90° and hence can be said to be inclined in the forward direction with respect to center line z—z. Inclination of axis M—M, the degree of which varies in accordance with the geometry of the airfoil 38, is advantageous for a number of reasons. First inclination of axis M—M reduces the net moment of force exerted on airfoil 38 by the air flowing in annular passageway 32. More specifically, since center 36 is disposed aft of the midpoint O, if axis M—M were disposed at an angle of 90° with respect to center line z—z, the forces exerted by the flowing air on that portion of airfoil 38 forward of the axis of rotation M—M would be substantially larger than the forces exerted by the flowing air on that portion of airfoil 38 aft of the axis of rotation M—M. This net moment of force must be reacted by ruggedized linkages which control the position of airfoil 38. By inclining axis M—M in the forward direction as shown, the magnitude of surface area of airfoil 38 forward of axis M—M may be made to approximate the magnitude of the surface area aft of the axis M—M. In this manner, then the net moment of force about axis M—M is reduced and hence the positioning linkage (not shown) can be made lighter and less rugged with attendant cost savings.

A second advantage of inclining axis M—M is realized through better control of clearances between the radially outer facing end face 42 of airfoil 38 and outer wall 31. Specifically, the distance from axis M—M along face 42 to the forward leading edge corner 44 of airfoil 38 is reduced. Hence, for any specific amount of rotation of airfoil 38 about the M—M axis, the movement of leading edge corner 44 is reduced, which in turn permits better control of clearance variation. Additionally, since airfoil 38 rotates about inclined axis M—M, the aft trailing edge corner 46 rotates about the M—M axis. Rotation of corner 46 in this manner causes corner 46 to move in a plane of rotation perpendicular to the M—M axis and shown as r in FIG. 2 as extending perpendicularly into the page. Viewing FIG. 2 in conjunction with FIG. 3, which schematically depicts an axial aft view of flow path 32, it may be observed that the sweep of corner 46, as airfoil 28 is rotated, may be made to encompass a locus of points approximating the curvature of wall 31. Assume, for the sake of illustrating this aspect of the invention, airfoil 38 must rotate over an arc such that corner 46 moves between points g and h. Assume further that the clearance between corner 46 and wall 31 is established when the airfoil 38 occupies the position wherein corner 46 is at g. As airfoil 38 is then rotated about the inclined M—M axis, corner 46 follows the dashed line shown in FIG. 3 and plane r shown in FIG. 2 until corner 46 occupies the position at g. Rotation of airfoil 38 in this manner results in the reduced clearance between corner 46 and wall 31 since corner 46 moves toward wall 31, as best seen in FIG. 2. It is observed that had corner 46 rotated about a vertical axis of rotation in accordance with prior art teachings, it would have rotated in a plane of rotation parallel to center line z—z and corner 46 would have moved in a horizontal plane, as viewed in FIG. 3, from point g to point i. With such prior art movement, the clearance between corner 46 and wall 31 would have increased as the corner moved from point g to point i. Hence, it is clear that with an inclined axis of rotation the control of clearance variation is enhanced, since corner 46 generally follows the curvature of wall 31. It should be stated that the degree of inclination of axis M—M is selected in accordance with specific flow path geometry and airfoil rotation arc. While the clearance between corner 46 and wall 31 at position g may be selected to be slightly larger than with prior art schemes, the final clearance at h will be substantially less than the clearance attainable with verticle rotation. Consequently the variation in clearance with an inclined axis is substantially less than that achievable with verticle rotation.

A modification may be made to the preferred embodiment shown in FIG. 2, wherein the clearance between surface 34, and different points on end face 40 varies and wherein the clearance between any point on end face 40 and surface 34 remains constant as airfoil 30 is rotated about the M—M axis. This result is obtained by making the radius of curvature of end face 40 equal to R, the radius of curvature of surface 34, and then displacing center 37 from the center location 36 by the distance Δ along the axis of rotation M—M. With such an arrangement the distance between surface 34 and face 40 along the axis M—M is equal to Δ. Other points on face 40 are separated from surface 34 by a distance less than Δ. However, the distance between any specific point on end face 40 and surface 34 remains constant as airfoil 30 is rotated about the M—M axis between the aforementioned first and second positions.

The preferred embodiment shown in FIGS. 2 and are depicted with wall 30 shown as continuous. However, it should be understood that wall 30, which partially defines the gas flow path 32, may be comprised of segments, some of which may be portions of a rotating engine component and others of which may be stationary structure. In this regard, spherical surface 34 may comprise either a stationary or rotating segment, the former in the form of a stationary shroud and the latter in the form of a rotating shroud.

It will be understood that the preferred embodiment of the invention is well adapted to attain the aforestated objectives and that various modifications and alterations may be made to preferred embodiment without departing from the scope of the appended claims.

I claim:

1. For use in a gas turbine engine having an axially extending flow path disposed circumferentially about the axial centerline of said engine, the invention comprising:

a first axially extending wall disposed circumferentially about said center line, said wall comprising a surface of revolution about said axial center line, said wall disposed with respect to said center line such that the distance between said wall and said center line is non-constant, said wall having a circumferentially and axially extending radially facing spherically contoured face having a first center of curvature disposed at a first location on said centerline;

a second axially extending wall disposed circumferentially about said center line, said second wall comprising an entirely non-spherical second surface of revolution about said axial center line, said second wall disposed with respect to said center line such that the distance between said second wall and said center line is substantially constant;

a variable position airfoil residing in and extending across said flow path between said first and second wall and having a radially contoured end face having a second center of curvature disposed at a second location, said end face disposed in spaced apart confronting facing relationship with said spherically contoured face of said first wall, said airfoil adapted to rotate about an axis of rotation intersecting said center line at an angle less than 90° at said first location.

2. The invention as set forth in claim 1 wherein said airfoil includes a first surface area forward of said axis of rotation and a second surface area aft of said axis of rotation, said first surface area being substantially equal to said second surface area.

3. The invention as set forth in claim 1 wherein said second location is disposed on said axis of rotation at a point remote from said first location.

* * * * *